US007819151B1

(12) United States Patent
Kuhn

(10) Patent No.: US 7,819,151 B1
(45) Date of Patent: Oct. 26, 2010

(54) UTILITY EQUIPMENT COVER

(76) Inventor: James J. Kuhn, 405 Locust Rd., Wayne, PA (US) 19087

( * ) Notice: Subject to any disclaimer, the term of this patent is extended or adjusted under 35 U.S.C. 154(b) by 381 days.

(21) Appl. No.: 12/099,693

(22) Filed: Apr. 8, 2008

Related U.S. Application Data

(60) Provisional application No. 60/910,694, filed on Apr. 9, 2007.

(51) Int. Cl.
*B65D 77/00* (2006.01)

(52) U.S. Cl. ..... 150/154; 150/165; 428/17; 428/27; 428/99; 428/919

(58) Field of Classification Search ..... 428/919, 428/99, 17, 27; 150/154, 165, 158; 52/3
See application file for complete search history.

(56) References Cited

U.S. PATENT DOCUMENTS

| | | | |
|---|---|---|---|
| 2,113,523 | A | 4/1938 | White |
| 2,251,705 | A | 8/1939 | Gonzalez |
| 3,170,587 | A | 2/1965 | Beeber |
| 3,193,852 | A | 7/1965 | Murrmann |
| 3,647,605 | A | 3/1972 | Spiegel |
| 3,928,712 | A | 12/1975 | Sears |
| 4,813,441 | A | 3/1989 | Kepley |
| 5,414,950 | A | 5/1995 | Johnson, Sr. |
| 5,520,003 | A | 5/1996 | Cornfield |
| 5,609,176 | A | 3/1997 | Weeks |
| 5,989,656 | A | 11/1999 | Solomon |
| 6,306,471 | B1 | 10/2001 | Pitman et al. |
| 6,543,175 | B1 | 4/2003 | Tucker |
| D492,758 | S | 7/2004 | Burbridge |
| 6,807,782 | B2 | 10/2004 | Forman et al. |
| 2006/0165931 | A1 | 7/2006 | Gaulrapp et al. |

*Primary Examiner*—Alexander Thomas
(74) *Attorney, Agent, or Firm*—Jeffrey C. Lew

(57) ABSTRACT

A cover for concealing utility equipment on real property such as air conditioner condenser units, telephone and electric cabinets, and trash containers, has a modular, rigid and stiff skeletal frame and a shell of flexible openwork material. The shell includes artificial foliage such that the cover appearance closely simulates natural plants and is aesthetically compatible with the local environment. Lengths and angles between components of the cover and the number of components can be adjusted such that a single cover kit is alone or in combination with supplementary components adaptable to fit objects of different sizes and shapes.

20 Claims, 17 Drawing Sheets

103

UTILITY EQUIPMENT COVER

This application claims benefit of U.S. provisional patent application No. 60/910,694 filed Apr. 9, 2007.

FIELD OF THE INVENTION

This invention relates to covers, and more specifically, to adjustable size and shape, openwork, faux foliage-adorned covers to provide an aesthetically appealing appearance to unsightly objects such as outdoor utility boxes, air conditioner condensers and garbage containers.

BACKGROUND OF THE INVENTION

Owners take pride and go to great effort and expense in providing aesthetically pleasing outdoor appearance for their residential and commercial real properties. Typically they establish well-kept lawns, shrubs, landscaping and other horticultural effects as well as tasteful ornamental design to developed structures.

It is often necessary to place utilitarian objects such as air conditioner condenser units, and trash containers on these properties. Frequently the industrial service aesthetic of such objects is inconsistent with the exterior image of the property that the owner strives to create.

A common solution to this problem is to conceal the unsightly objects from view with pleasing barriers such as plants or fencing. This solution often has shortcomings. Live plants may be expensive, require care and attention, and occasionally may not be possible to cultivate due to local environmental conditions. Fencing may also be expensive and may block service access to the shielded objects and make ongoing maintenance of nearby landscape more difficult.

Many fabricated devices that include use of artificial or simulated foliage to block from view aesthetically displeasing objects have been suggested. Among these are the following.

U.S. Pat. No. 3,170,587 to Beeber discloses devices for concealing and supporting refuse receptacles comprising a panel ornamented to simulate a fir tree or shrub.

U.S. Pat. No. 3,928,712 to Sears discloses a post terminal having a wire support frame with simulated foliage attached to the frame. The post terminal is configured to mount over an existing utility terminal enclosure to conceal the terminal.

U.S. Pat. No. 5,989,656 to Solomon discloses a container cover with foliage to aesthetically cover a container.

U.S. Pat. No. 6,807,782 to Forman et al. discloses a decorative wall having a flat surface indicia or images printed thereon which hides residential equipment.

US Patent Application Publication 2006/0165931 of Gaulrapp et al. discloses a fabric cover for installation on utility boxes and having a non-projecting pattern that functions to reduce the visual impact of the utility boxes on the surrounding landscape.

U.S. Design Pat. D492,758 to Burbridge discloses an ornamental design for surfaces of an air conditioner/heat pump unit.

Conventional solutions to this problem also suffer from drawbacks such as being costly, flimsy, and customized for particular shapes of objects to be hidden. It is desirable to have an aesthetically pleasing way to conceal unattractive objects that is durable, requires minimal maintenance, and which is made of synthetic materials yet closely simulates the appearance of natural foliage. Furthermore, there is advantage for a device that can easily be adapted to effectively shield many differently sized and shaped objects.

SUMMARY OF THE INVENTION

Accordingly, the present invention provides a cover for shielding an object from view comprising a substantially horizontal cap adapted for placement above the object, the cap defining a peripheral outer rim and an inner hole with a peripheral inner lip, an elongated, substantially horizontally oriented top rail coextending with the rim, an elongated, substantially horizontally oriented bottom rail below and separated at every longitudinal position along the rail lengths from the top rail by a vertical distance exceeding the height of the object nearest such respective longitudinal position, a plurality of elongated, substantially vertically oriented studs spaced apart along the rail lengths and rigidly connecting the top rail with the bottom rail, an openwork flexible shell affixed to the studs and the rails and congruent with an area extending from the rail length of the bottom rail, over the top rail to the inner lip of the cap such that the shell blocks view of the object from at least three orthogonal horizontal directions and from above except for view of the inner hole, and artificial foliage applied to the shell in which the openwork of the shell defines voids, and in which the voids and the foliage are present to an extent effective to permit flow of air through the cover at least equal to ventilation specifications of the object.

DETAILED DESCRIPTION OF THE INVENTION

Figure 1:
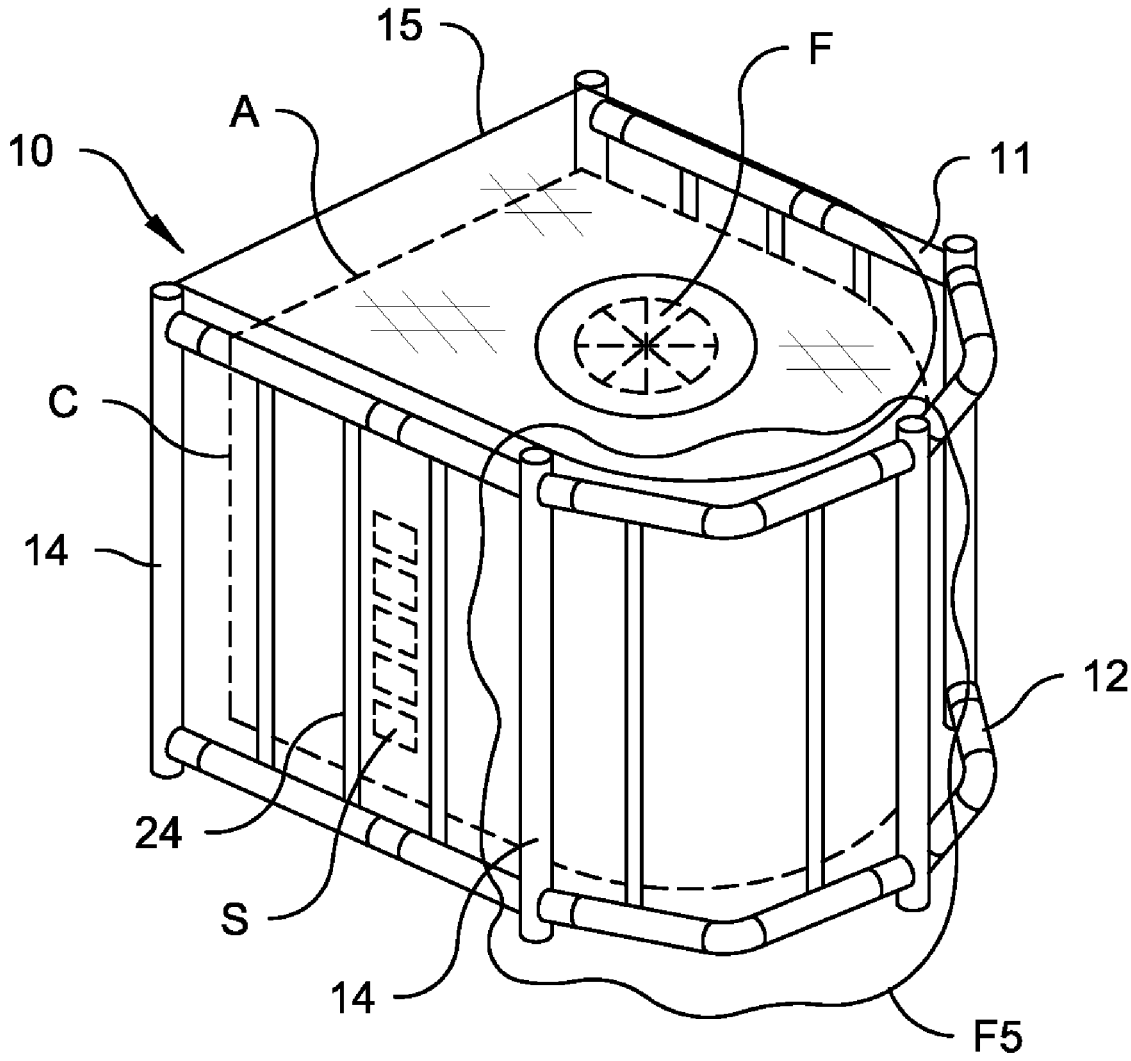
FIG. 1 is a perspective view of a schematic diagram of the skeleton of an embodiment of the novel cover.
Figure 2:
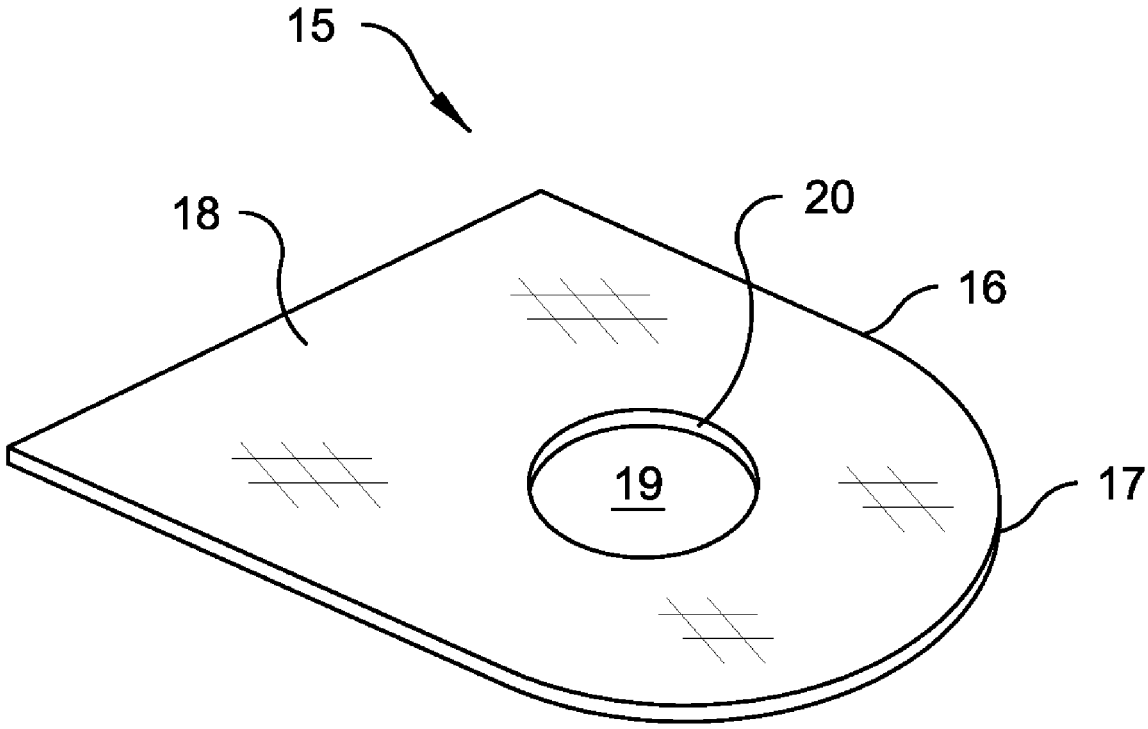
FIG. 2 is a perspective view of the cap for the embodiment of the novel cover of FIG. 1.

The entire disclosures of every U.S. patent document identified in this application is hereby incorporated herein. The term "substantially" as used herein to characterize a property such as "horizontal" and "vertical", means that the orientation of the referenced element is not restricted to being absolutely horizontal or vertical but may diverge either slightly from horizontal or vertical, or may be largely horizontal or vertical with relatively small portions of the whole deviating even significantly from horizontal or vertical, as the case may be. In the drawings, like parts shown in different figures are identified with the same reference numbers.

The novel utility equipment cover can be understood with reference to FIGS. 1-5. FIG. 1 depicts a representative embodiment 10 of the frame (occasionally referred to as a "skeleton") of an embodiment of the novel cover as it would conceal a conventional hidden object A, shown in dashed lines, for example, an outdoor condenser unit for a residential or commercial central air conditioning installation. Typically, such condensers sit on a pad on the ground. The condenser is enclosed in a case C and usually has an exhaust system which in operation draws cooling air through ventilation slots S on the sides or elsewhere on case C and blows heated air out from the top via a fan F. Thus it is important for this application that the cover does not restrict air flow from most areas of the case and especially at the discharge of the fan.

FIG. 1 identifies the basic elements of the cover and illustrates their relative positions. The frame of the cover has an elongated, substantially horizontally oriented, top rail 11 extending circumferentially around the cover above the concealed object. There is a similarly elongated and oriented bottom rail 12 extending circumferentially around the cover a distance below the top rail and near the bottom of the object. Preferably the vertical distance between the top and bottom rails is greater than the height of the concealed object so that the fully constructed cover will be taller than and completely hide the object from outside view. The cover includes a plurality of substantially vertically oriented studs 14 which are spaced apart from each other along the rails. The studs connect the top rail and bottom rail and fix the distance between them. The rails and studs are the primary load-bearing members for the cover and therefore are appropriately strongly and generally stiffly constructed. The number of studs deployed will depend on the size and shape of the cover and should be selected to maintain the desired distance between the rails over the full rail length. Preferably the studs are positioned at corners and ends of the rails, however, the precise longitudinal positions of the studs is not critical. The path of the rails and placement of the studs are selected to conform roughly to the exterior footprint area of the concealed object.

A cap 15 is shown in FIG. 1 as a substantially horizontal structural element situated above the concealed object and near the elevation of the top rail 11. The main function of cap is to support the shell of the cover on top of the object. For clarity, the cap 15 is shown isolated in FIG. 2. The outer periphery of the cap defines a rim 16. The rim follows closely but not necessarily identically to the path of the top rail. In the illustrated embodiment, the top rail is shown to have linear elongated segments and the forward portion 17 of the rim is curved. As illustrated, the cap is a sheet 18 of solid material, such as metal, plastic or wood. Typically such a sheet stock cap is very thin, preferably less than about 0.25 inch thick. As mentioned, the illustrated cap is adapted for use with a top-exhausting air conditioner condenser. Accordingly the cap defines a hole 19 situated in position corresponding to the fan discharge port. The hole is sized at least as large as the discharge port to prevent restriction of fan discharge flow. The inner edge of the cap defines the lip 20 of the hole.

Various techniques can be employed to position the cap. For a suitably stable, substantially flat and preferably motionless object, the cap can simply rest upon the top of the object. The cap can optionally be clamped in place by sets of opposing clamps affixed to the cap near the rim and extending downward. The clamps can then be moved inward with conventional mechanisms such as threaded bolts, for example, to bias against the sides of the object. Other options include fastening the cap directly to the top of the object for example with screws. This method has a disadvantage that disassembly of the fasteners is required to gain access to the object from its top. In certain embodiments of the cover more fully described below, the cap is not affixed to the object so that the whole cover or an upper, lid portion of the cover can easily be lifted from the object for inspection or maintenance inside.

Figure 3:
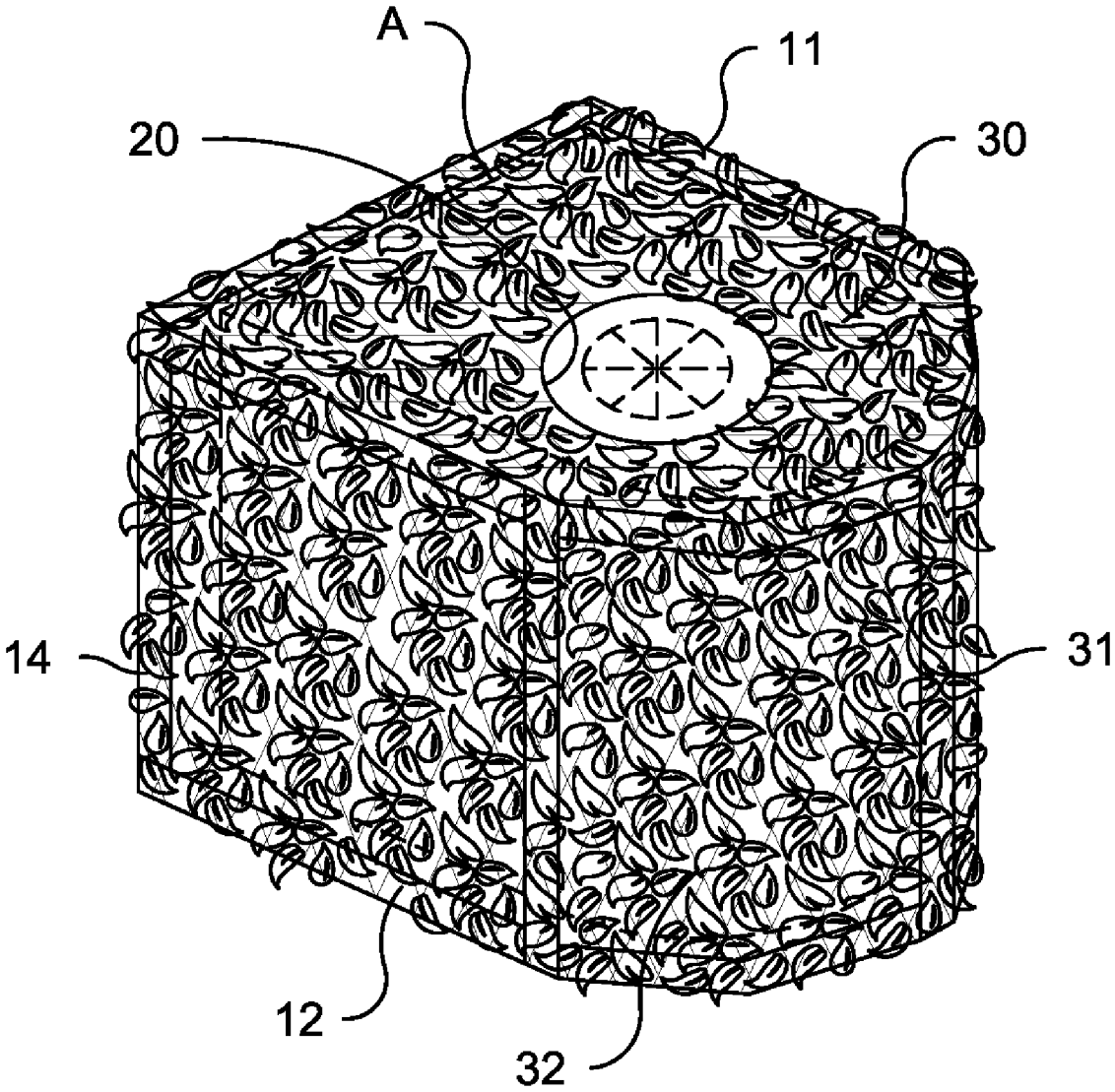
FIG. 3 is a perspective view of a skeleton of an embodiment of the novel cover fitted with an openwork shell material which is partially populated with artificial foliage elements to illustrate construction of the novel cover according to this invention.

The exposed, outer surface of the cover is a flexible shell 30 of openwork material 31 and artificial foliage 32, as seen in FIG. 3. The foliage is applied to substantially the whole of the cover outer surface although only a representative amount is shown in this figure for clarity. The shell extends from the bottom rail 12, upward and over the top rail 11 and congruent with the cap 15 on which it lies. Extension of the shell on the cap terminates at the inner lip 20 so as not to obstruct the hole and restrict discharge air flow from the fan of the object A. It should be understood that the path of the rails and the extent of the shell overlying the skeleton formed by the rails, studs and cap enclose the concealed object by shielding it from view from at least two, preferably three, orthogonal horizontal directions and from the vertical direction above the object. For objects located in an open field of view the cover optionally can be shielded also from the fourth orthogonal horizontal direction, By "orthogonal horizontal directions" is meant the directions of view toward the front, rear, left side and right side which directions are adjacent each other respectively by 90 degrees.

The openwork material 31 is a flexible yet strong and weatherproof mesh with heavy duty strands and significant voids between the strands. The material can be elastic. The flexibility property is to provide enough compliance to enable the cover shell to bend around curves of the cover skeleton, such as the 90 degree curvature between the vertical faces to the horizontal cap of a cover for a box-style air conditioner condenser such as shown in FIGS. 1 and 3. Outdoor fencing material such as welded strand or woven strand construction can be used. The strands can be metal, such as galvanized iron, plastic or a combination thereof, such as vinyl plastic coated metal. Any shape of the voids is acceptable and therefore common rectangular mesh, diamond mesh (sometimes referred to as "chain-link") or hexagonal mesh (sometimes referred to as "chicken wire" or "poultry wire" fencing) can be used. For flexibility the strand diameter preferably should be greater than 11 gauge and preferably greater than 14 gauge. Light weight, plastic mesh strand material of about 20-26 gauge, such as so-called "deer fencing" can be used in suitably stationary, quiescent equipment covering environments. Minimum diameter of the strands will also be affected by strength needed to accept and retain pieces of foliage attached to the openwork material.

The foliage density should be high enough to conceal the object from view and to simulate appearance of natural shrubs. A substantial number of foliage elements may be needed to be deployed. For good effect, the cover should also block view of the skeleton of the cover, i.e., the rails, studs, cap etc., as well as the underlying unsightly object. Strands of the openwork material can contribute to the blocking property but the mesh should not be so small as to adversely affect air flow through the cover. The equipment being concealed such as an air conditioner condenser unit usually has manufacturer-specified limits of low intake air flow through the unit case. The openwork material voids should not be so small that the passage of air through the shell, including the foliage, is less than the covered equipment ventilation specifications. Moreover, the mesh voids should be large enough to permit attachment of the foliage pieces. Preferably the nominal mesh voids will be in the range of about ½ inch-2 inches.

The openwork material of the shell can be attached to the skeleton rails, studs, rods etc. using any conventional fastener system. Typical fasteners include wire/cable ties, hook and loop fasteners, elastic cords with hooks, and hose clamps. It is contemplated that the edges of the openwork material can be held to the rim by hooks connected to the openwork material by short lengths of elastic mechanism such as elastic cord or spiral metal springs. The hook and elastic connector method can be used to great advantage to draw the shell over the top of the cap and securing the hooks to the lip of the hole in the cap. When the concealed object includes an exhaust fan with an integrated wire grid fan protection grate, the hooks with elastic cords can be conveniently hooked over the fan protector wires.

Preferably, the cover should not contact the outer surface of the concealed object and there should be a gap of at least 4 inches between the object and the inside of the cover. The novel cover can include an optional, second filtration layer of fine screen inside the cover, that is, between the shell and the concealed object. The filtration layer is intended to keep dirt and debris, such as lawn mowing clippings and fallen leaves from fouling the object. Because the object will normally be out of sight under the cover, it will not be as easy to check that the surface of the object is clear of debris as would be if the object were exposed. The filtration layer should have a mesh with opening size of at most about 0.25 square inches but should not be so fine as to excessively restrict access of ventilation air to the object.

Figure 4:
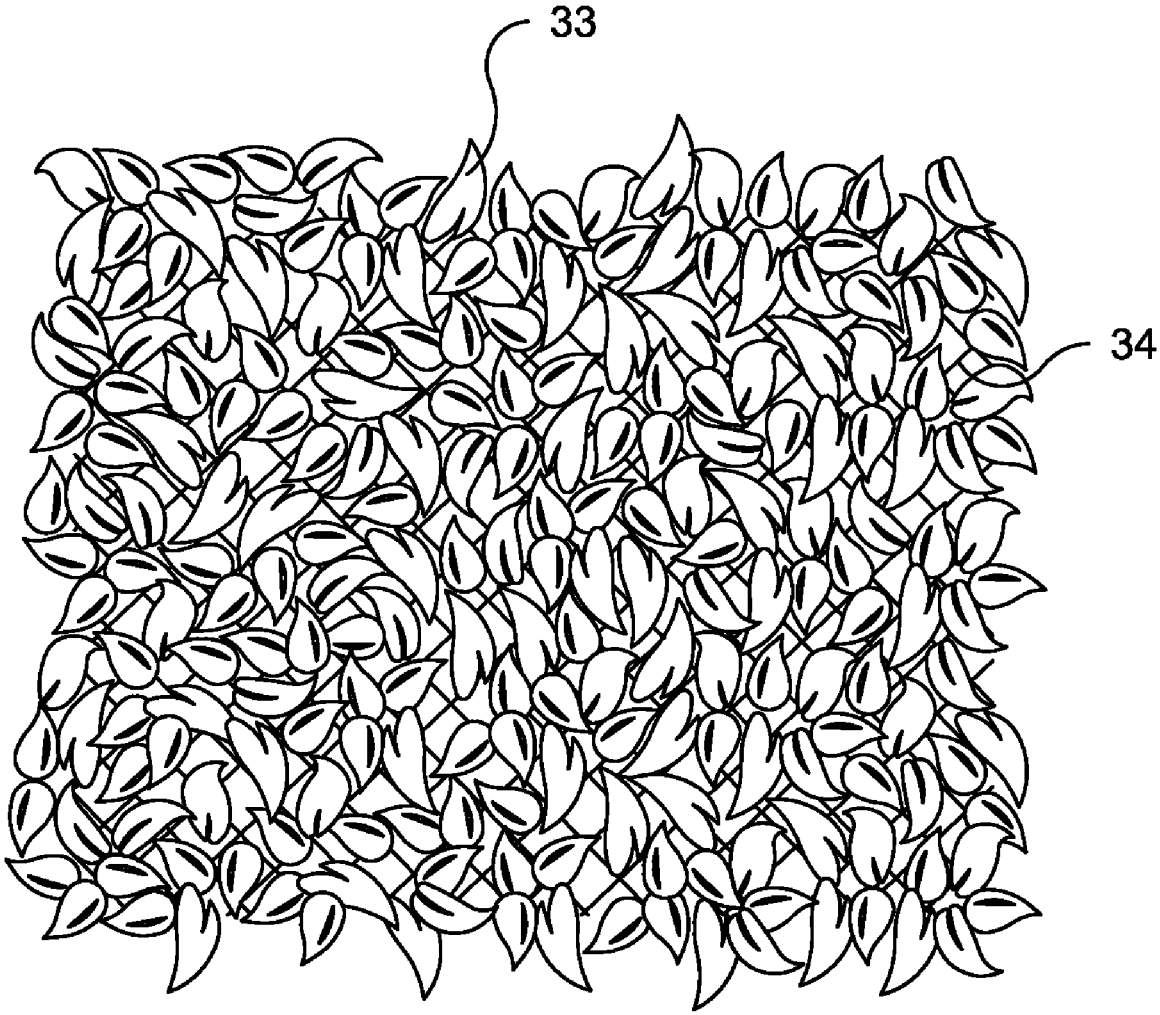
FIG. 4 is a front elevation view of another embodiment of the novel cover with the openwork shell material fully populated with leaf-like foliage elements.

The foliage can be any type of artificial foliage well known in the art. The individual elements can be artificial leaves, flowers, vines, fruit, fronds, stalks, ivy and the like, preferably selected for appearance that simulates foliage complementing the particular environment near the concealed object. The foliage elements can be attached to the openwork shell material individually or the elements can be strung together as in a garland form and the strings of garland affixed to the shell. An example of a typical artificial foliage element suitable for use is a simulated pine branch disclosed by U.S. Pat. No. 3,647,605. It comprises a short length of twisted wire core which retains plastic bristles or "needle-like" leaves. The short length is preferably bent in half in a U-shape and the valley of the "U" can be affixed to the strands of the openwork material, for example by wire wraps. A representative openwork shell material according to this invention is represented in FIG. 4, in which leaflike artificial foliage elements 33 are seen deployed upon the openwork shell material 34.

In a particular embodiment illustrated in FIG. 5 and discussed in greater detail below, the rails are constructed from short (compared to the whole rail length) linear, elongated members joined together by connectors to make a longer rail. These linear, elongated members are preferably rigid, i.e., essentially not flexible. Typical composition is hollow tubular metal construction. Alternatively and preferably, the rails can comprise longer stiff members. The term "stiff" is used here to mean that the members can yield to substantial flex force to small deflections. Typical materials having this property are heavy duty, generally thick-wall (i.e., about 0.12 inch thick) rubber hose, plastic irrigation tubing such as acrylonitrile-butylstyrene ("ABS") tubing, and fiberglass rods. Stiff rail members provide the advantage that the slight flexing capability permits the rails to assume a curvature that fits various types of objects and better simulates the curvature of natural shrubbery.

Figure 17:
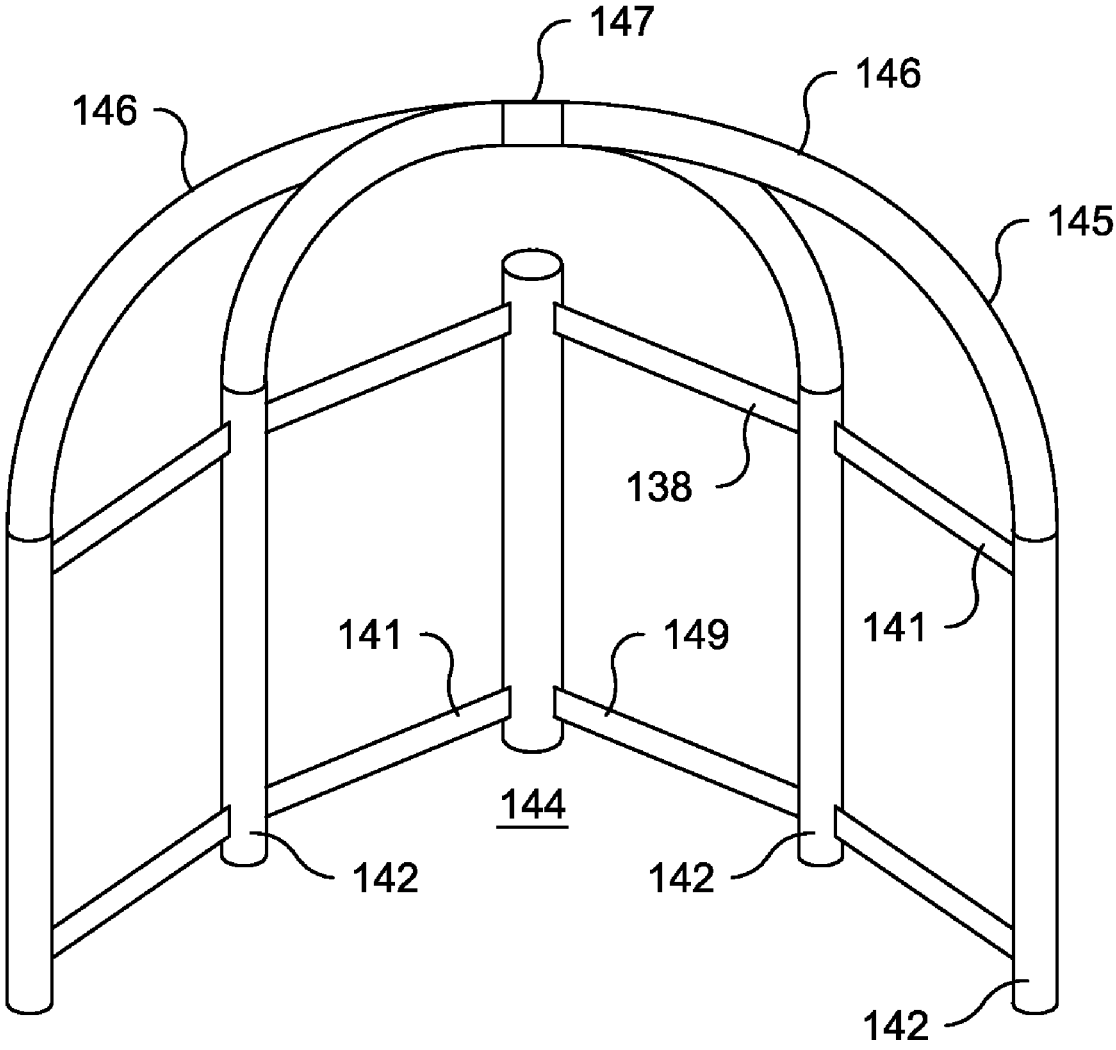
FIG. 17 is a schematic perspective view of a skeleton for a cover according to another embodiment of this invention.
Figure 20:
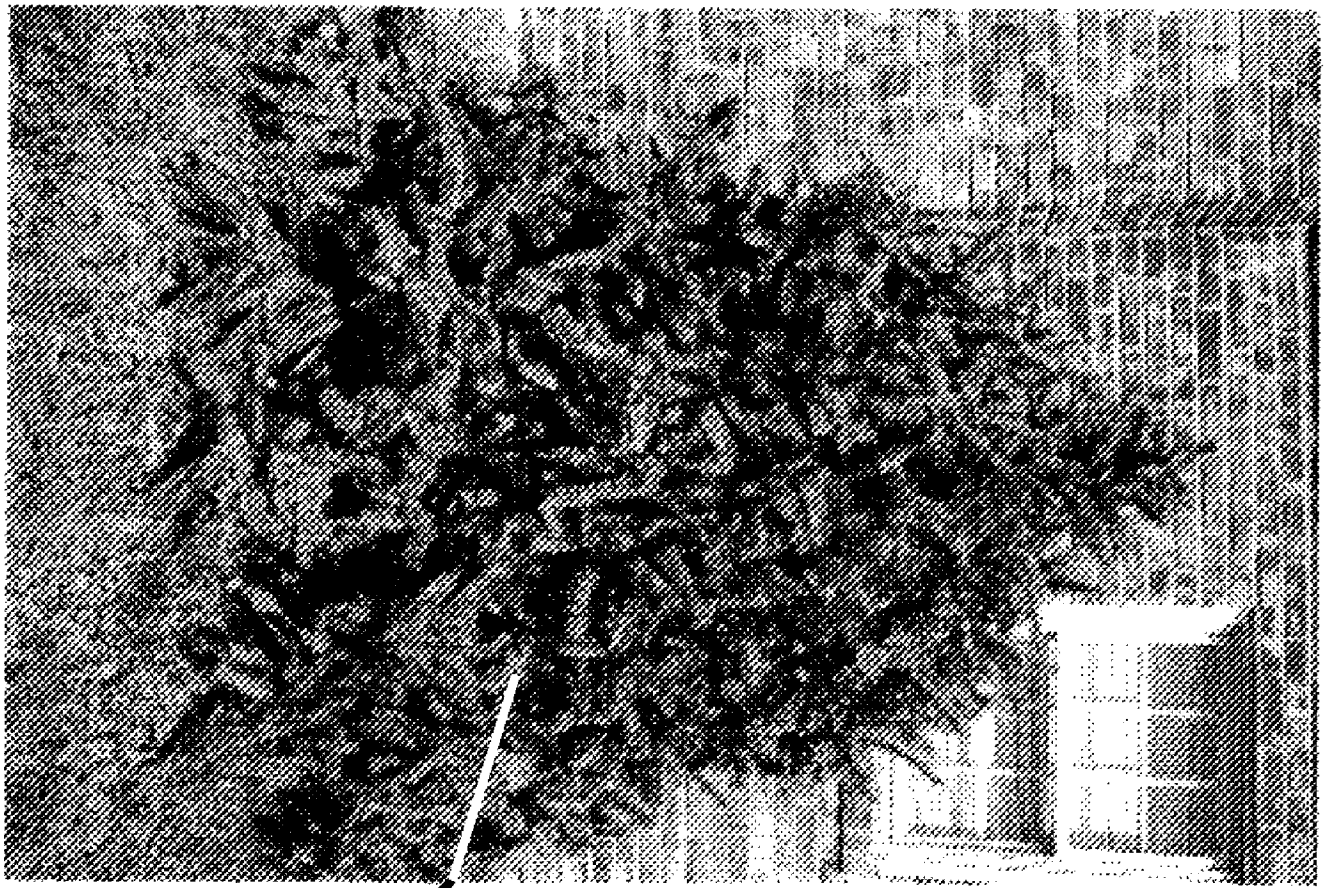
FIG. 20 is a photograph of another embodiment of the utility equipment cover according to this invention.

In a particularly preferred embodiment, stiff rubber hose can be used to extend upward from the studs, curve inward across the cover to form an arched canopy frame for the cover. Such a skeleton is shown schematically in FIG. 17. Top rail 138 and bottom rail 149 are formed by substantially horizontal short rigid members 141 which are strung between substantially vertically oriented studs 142. The skeleton encloses an area 144 where an unsightly object can be concealed. A canopy 145 is formed by mounting stiff rubber hose pieces 146 upward from the upper ends of each stud 142 and binding the hoses together at an arched peak by a suitable fastener 147 such as tape, hose clamp, twine, and the like. Foliage attached to this skeleton, especially artificial pine needle-type sprigs can cause the cover to assume a realistic and natural looking evergreen plant such as equipment utility cover 103 seen in FIG. 20.

Figure 5:
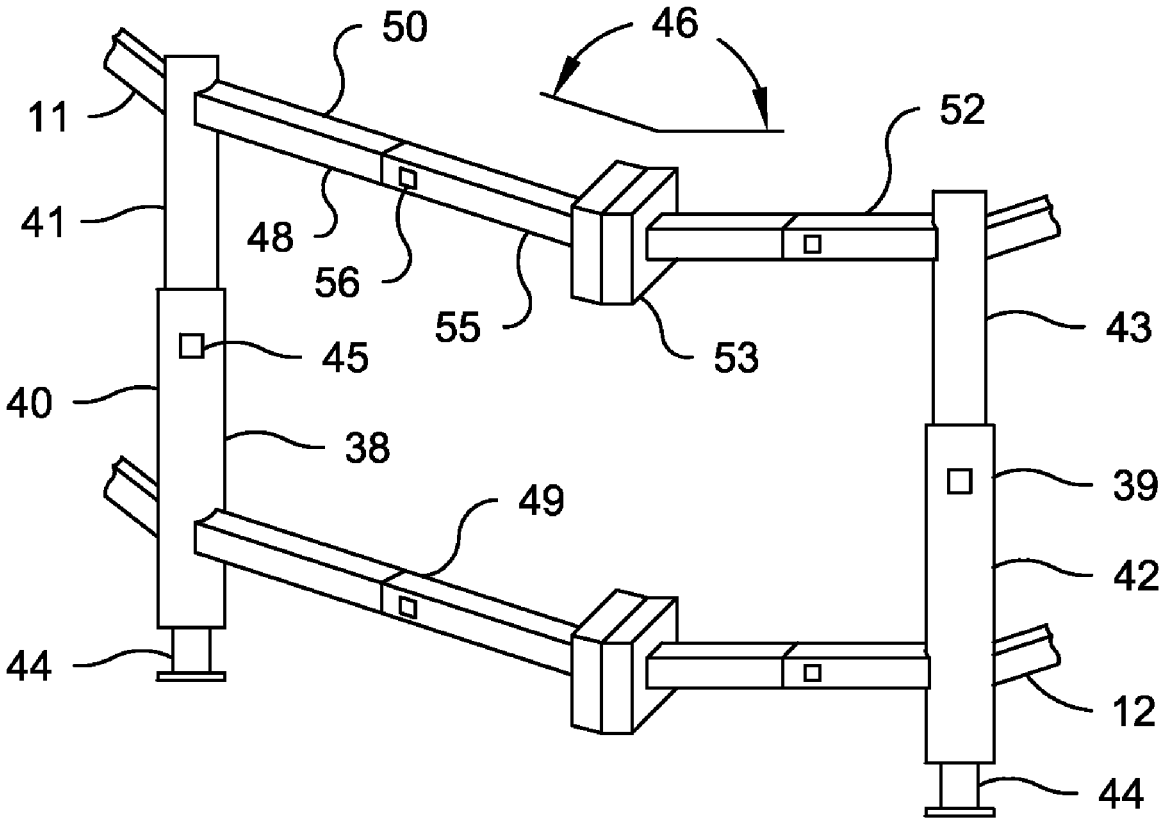
FIG. 5 is a detail view of the skeletal components within the area $F_5$ of FIG. 1.

Additional details which provide particularly advantageous features of the novel cover can be understood with reference to FIG. 5. This is a detail view of the skeletal components within the area $F_5$ of FIG. 1. More specifically, the figure shows two adjacent studs 38,39 and segments 48, 49 of top rail 11 and bottom rail 12, respectively. The structures of the rails and studs is such that the studs are extendable vertically to variable degree which allows the distance between top and bottom rails to be adjusted as might be needed to fit objects of different heights. Similarly, the rails are extendable lengthwise such that the distance between studs can be adjusted to adapt the cover to fit objects of different footprint area sizes. Still further, the rails are segmented and the segments are connected head-to-tail by articulating joints in such a way that the relative horizontal positions of the studs can be modified. This feature enables the novel cover to fit objects of different shapes. These aspects of the invention will now be described in further detail.

As seen in FIG. 5, the studs comprise plural rigid tubular components 40-43. At least one tubular component of each stud, e.g., 40 and 42 is hollow and has an inner diameter large enough to accept another tubular component, 41 and 43, respectively, inserted longitudinally in telescoping fashion inside the larger component internal cavity. Thus by sliding component 41 up or down into hollow component 40, the height of stud 38 can be adjusted within a range. When the desired height of the stud is achieved, the positions of the tubular components can be fixed, for example by tightening set screw 45 in a threaded hole in component 40 such that the tip of the set screw contacts tubular component 41.

In another contemplated embodiment, the rails comprise segments of rail lengths that span between adjacent studs. At each end of the segments are short tubular sleeves adapted to slide vertically on the studs. Thus the height of the rails can be adjusted as a unit by loosening a set screw through the sleeves anchoring the sleeves to the studs, raising or lowering the segment of rail, and retightening the set screws at both ends of the rail length segment.

Any other conventional extension and locking mechanism can be used for this function. For example, components 40 and 41 can have mutually mating threaded ends such that one component screws up or down into the other. Another height adjusting technique contemplated as suitable for this purpose is to have a series of holes drilled at different heights through one stud component and a single hole drilled through the mating stud component such that raising or lowering one component in the other causes particular holes to align and permits inserting a pin to lock the alignment and height of the stud.

FIG. 5 also shows that rail segments 48,49 are formed from stiff elongated members 50 and 52 connected head-to-tail between neighboring studs 38 and 39 by joints 53. The joints are capable of adjusting the angle 46 of alignment in the horizontal plane of rail members 50 and 52. The number of rail members with intermediate joints between a given pair of studs can be larger than illustrated. Moreover, the joints are optional and can be eliminated if the studs are positioned along a straight path, that is, angle 46 is 180 degrees. This feature enables the studs to be laterally positioned around the object such that a single cover can adapt to fit objects of different shapes.

FIG. 5 further illustrates that the cover skeleton can optionally include a plurality of feet 44. The feet are depicted as extending downward preferably from the studs 38, 39. However, the feet can be positioned anywhere along the path of the bottom rails. The feet are height adjustable and can be used to make the cover level on irregularly graded ground. Mechanisms for level-adjustable feet are well known in the art.

It has been noted that a preferred application for this invention is to cover air conditioner condenser units. Such units are commonly mounted on pads erected specifically to hold the unit. More recently, condenser pads are being fabricated as pre-cast plastic platforms. It can be desirable to mount the novel cover on the pad of the unit. Accordingly it is contemplated to provide for the cover plastic or concrete pads with mounts for the cover. In one embodiment the pad can have pre-formed pedestals prepositioned to meet feet of the cover. In another embodiment the pad can have prepositioned cup-shaped receptacles into which cover feet can be inserted.

Still further and similar to the stud construction, the segments of the rails are adjustable in length by telescopically extending a rail member 50 with a mating rail member 55. When the desired length of overlapped rail members 50 and 55 is achieved, the length can be locked by conventional means such as by tightening set screw 56. Each pair of rail members can be adjusted in the same way. This feature enables the lengths of the segments between neighboring studs to be extended or contracted and thereby permits a single cover to fit objects of different footprint area sizes.

Each of the length and angle adjustments for studs and rail members are reversible(i.e., locked to hold condition until unlocked). Thus a kit containing multiple rail members and stud components of standard size can be used to assemble component parts in a way that creates a suitably fitting skeleton of a cover for an object of particular size and shape. The lengths and heights of the components can be fixed by locking the rigid and stiff members in relative position with clamps, set screws, etc. as just described. Later as the need might develop, the skeleton can be disassembled or adjusted by unlocking the length and height adjustments (that is, reversing the locking steps). Later still, the same components can be re-used by adjusting lengths, heights and positions to surround and conceal a different object of different shape, height or footprint area size. Advantageously, the components are interchangeable and additive with other parts from cover kits of standard sizes. Thus covers can be constructed for generally any size or shape of unsightly object by combining adding rail members, joints, and/or studs.

FIG. 1 also shows that the skeleton 10 can optionally further comprise a plurality of elongated rods 24 positioned between and connecting the top rail and bottom rail. That is, with a suitable threshold magnitude force applied, the rods can be bent to a new shape and will hold the modified shape until and unless another large force is applied. For example, the rods can be bent outward to give the skeleton, and subsequently the cover, an outwardly bulging curved surface contour instead of a straight and flat vertical profile. This enables the cover to more closely simulate the curvature of natural shrubbery and thereby more compatibly disguise the unsightly object within the cover. In one aspect the rods are "settably deformable". Preferably, the rods are a flexible composition such as solid polyvinyl chloride ("PVC") dowels about 3/16-3/8 inch in diameter. Thus the rods bow outward to a smooth curvature when compressed. The curvature to the rods can be produced by inserting straight rods of fixed length between the top and bottom rails with the rails being set at greater distance apart than called for by the installation. Then the top and bottom rails are drawn towards each other, for example, by screwing the segments of telescoping studs. The force created by shortening the top-to-bottom rail distance causes the rod to flex forming an outwardly defecting bow.

Figure 22:
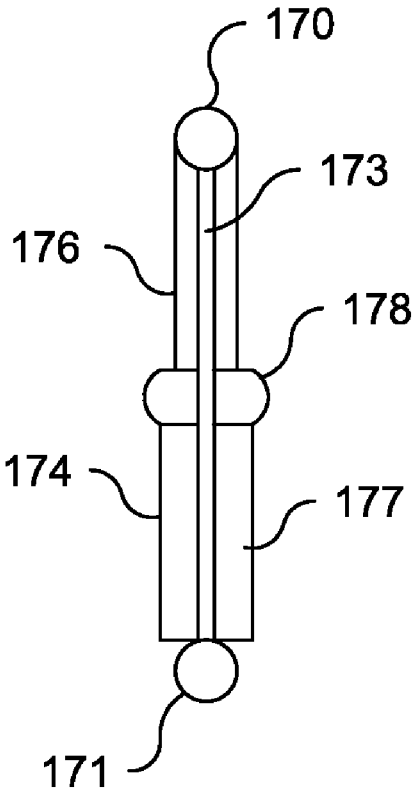
FIG. 22 is an elevation section view through top and bottom rails of the skeleton showing a flexible rod in straight conformation.
Figure 23:
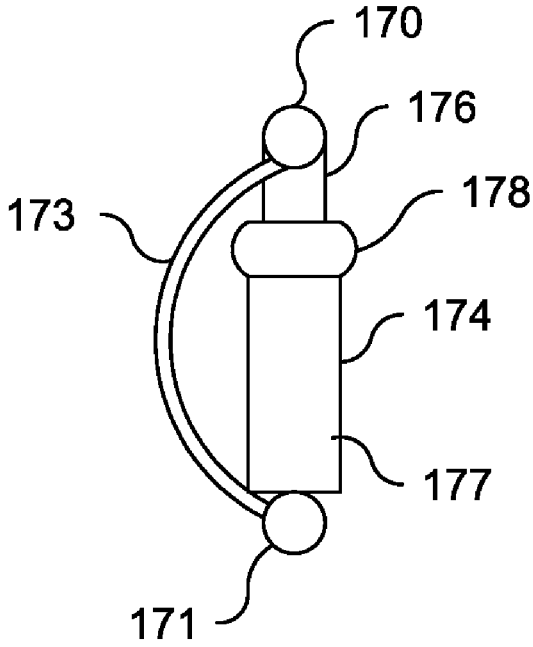
FIG. 23 is an elevation section view through the top and bottom rails of the skeleton of FIG. 22 with the distance between the rails reduced and the flexible rod in a bowed conformation.

Bowing of the rods is further illustrated in FIGS. 22 and 23 showing an elevation view of the skeleton of the cover at a cross section of top rail 170 and bottom rail 171. Rod 173 of fixed length is mounted closer to the viewer than stud 174. The stud comprises telescoping upper portion 176 and lower portion 177. Thus the length of the stud can be extended or shortened by sliding the upper portion into the lower portion and fixing the adjusted length by tightening compression collar 178. FIG. 22 shows rod 173 at full length with the rails separated by equivalent distance. In FIG. 23 it is seen that bringing the rails closer together causes the flexible rod 173 to bow outward giving a rounded shape to the cover.

The rods can be tubular (that is, hollow) or solid. The rods should have enough ductility that they can be bent to at least an obtuse angle (greater than about 90 degrees) without breaking or permanently creasing at the bend. Preferably the rod material is sufficiently elastic such that when compression is released, the rod returns to substantially its original straight conformation. It should also have adequate stiffness to retain its new conformation under ambient stresses to which the cover is subjected during normal use. Representative solid rod material includes thick aluminum, or galvanized metal wire, plastic dowels such as fiberglass of about 1/8-1/2 inch in diameter, and stiffly bendable plastic strips about 1/8-3/8 inch thick and about 1/2-1 inch wide.

Preferably the rods are installed inside the shell and the openwork shell material is affixed to the rods at one or more positions along the length of each rod. The rods can be attach to the rails by various methods such as with wire ties, screws or bolts, and opposing cup-shaped brackets that can be applied to each rail so as to receive the rod ends. Another contemplated technique is to provide bores or slots drilled into the rails at various longitudinal positions and being operative to accept the ends of the rods. The rods can be supplied to the cover user in standardized excess lengths which are able to be cut to appropriate size for a particular cover application. It is not considered essential that the rods be bent to a non-linear curvature for use according to this application. They may be used in straight line conformation as shown in FIG. 1 to supplement support of the shell provided by the studs 14. Preferably, the rods will be oriented substantially vertically in the skeleton of the cover. Optionally, substantially horizontally oriented rods can be substituted for and/or supplemental to the vertical rods shown in FIG. 1.

It is contemplated that a "starter" kit containing a standardized quantity of studs, rail members, cap material and shell material can be provided as a unit. This standard kit will be suitable to cover an object within a selected general size range. Supplemental parts can be obtained by the user if needed, and/or additional and larger kits can be combined in whole or in part to expand the coverage provided by the starter kit as the user might require.

To accommodate objects of various sizes, the shell material can be supplied in rolls in a range of different standard widths. Once an appropriate skeleton of rails and studs is assembled, the shell material can be cut to size from stock rolls and attached to the skeleton. As mentioned the shell material has sufficient flexibility that it can conform to the curvature demanded by the skeleton. In one embodiment, the shell material can be installed in a single piece extending from the bottom rail, upward along the sides of the cover, curving over the top rail rearward toward the back, hidden side, of the object onto the cap. This type of construction advantageously gives a much more rounded, and therefore natural appearance of the cover at the sharp angle between the vertical sides and typically flat horizontal cap exemplified by an air conditioner condenser unit such as A in FIG. 1. Alternatively, it is acceptable to divide the shell material in sections, for example a face section affixed to the vertical sides of the skeleton and a blanket section laid onto and affixed to the cap. In such embodiment there would be a seam in the shell along the top rail.

Figure 6:
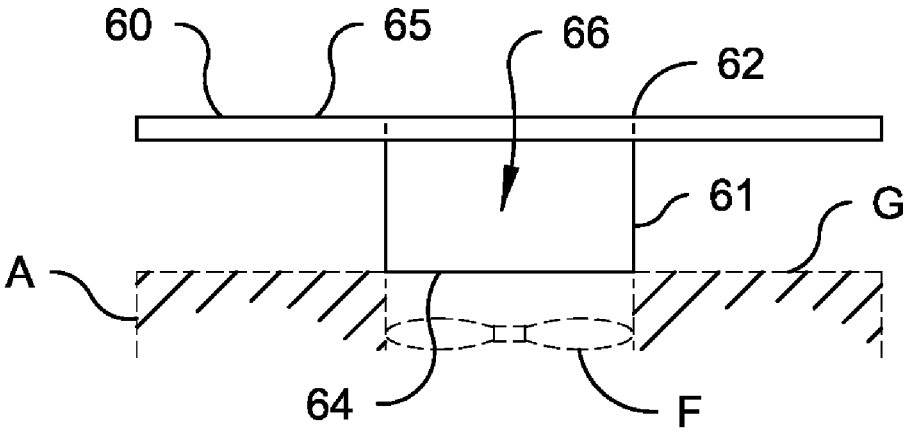
FIG. 6 is a side elevation view of a cap according to another embodiment of the novel cover.
Figure 7:
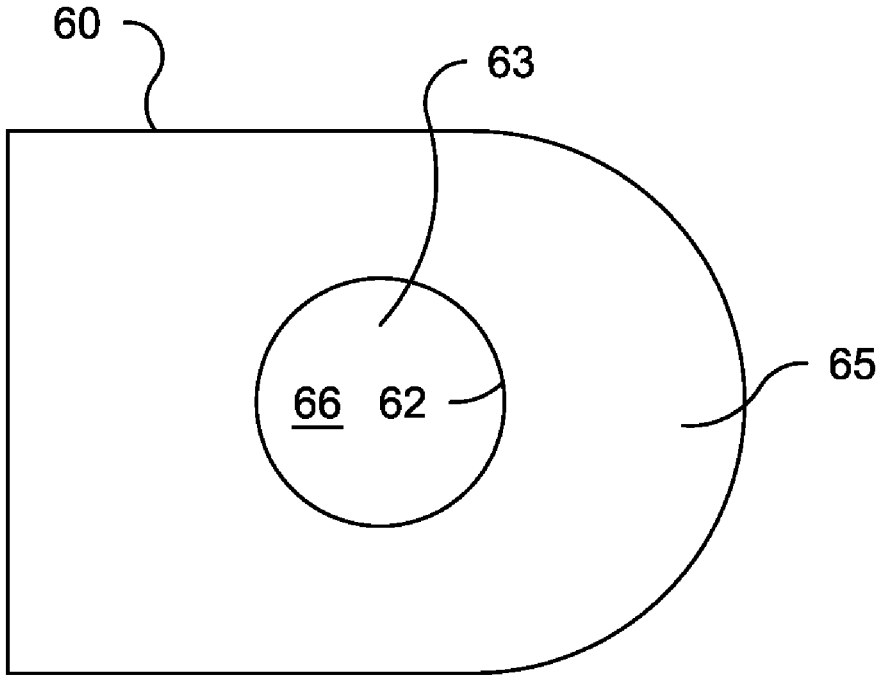
FIG. 7 is a plan view of the cap of FIG. 6.

In another embodiment, the cap 60 (FIGS. 6 and 7) includes a tubular sleeve 61 extending circumferentially from the lip 62 of the hole 63 in the cap. The end 64 of the sleeve can rest directly in contact with the top surface G of the object A. It is seen that the upper surface 65 is elevated above the object by the height of the sleeve 61. Thus there is defined a channel 66 along the axis of the sleeve which conducts air exhausted from the object A, such as an air conditioner condenser by fan F, through the sleeve to the outside air. The shell with artificial foliage lies on upper surface 65 of the cap.

In another contemplated embodiment, the object A air conditioner condenser can have its own guard, usually a coarse, strong and rigid wire mesh spanning over the exhaust port as a safety precaution to prevent people from reaching into the port while the fan operates, for example, to clean away debris that might have fallen into the condenser unit. Typically such guards are attached by prongs on legs of the guard that insert into holes in the top surface G of the condenser near the exhaust port adapted to mate with the prongs. For such an installation, the novel cover can have a cap 60 that optionally includes prongs (not shown) extending from the sleeve end 64 that can be used to anchor and further stabilize the cap on the object. That is, the existing fan guard is removed and the cap is placed on top of the condenser unit A with cap sleeve prongs inserted into the holes. In this embodiment, the cap can have its own integrated safety screen spanning the hole 63 to prevent accidental reaching into the condenser.

Figure 8:
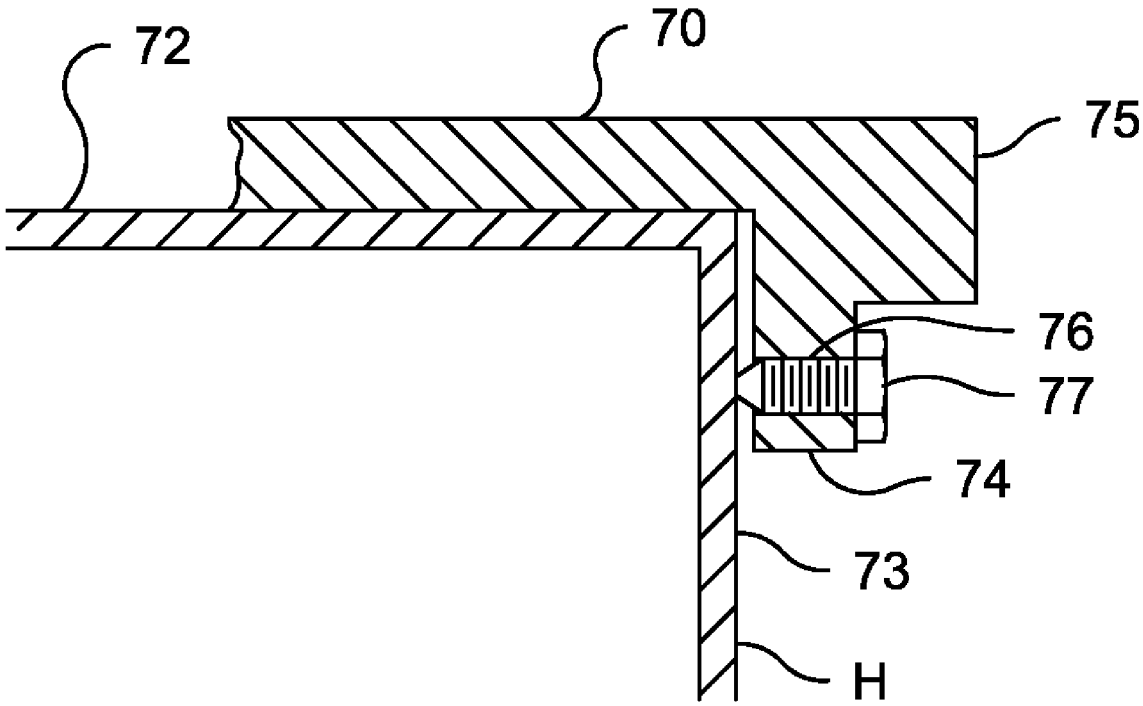
FIG. 8 is a detail section view of an upper corner of a concealed utility box with a portion of a cap resting on the top surface clamped to the utility box, according to another embodiment of this invention.

The cap can sit on the top surface of the concealed object and maintained in position by gravity and/or by attachment to the top rail members. In a preferred embodiment the cap is clamped to object. Any of various clamp types well known in the art are suitable for use. FIG. 8 illustrates a representative technique. The figure shows a detail section view of an upper corner of a utility box H with a portion of the cap 70 resting on the top surface 72 of the utility box. The side 73 of the utility box has a vertical surface. Cap 70 defines a flange 74 extending downward from the end 75 of the cap overhanging the box. The flange includes a female threaded through-hole 76. A complementary threaded set screw 77 is screwed into hole 76. A similar clamp is positioned across the top surface 72 of the box on the cap 70 opposite to end 75 in mirror image to flange 74 with an opposing set screw. The opposing set screws are tightened such that the screw tips bias against opposite outward sides of the box and thereby clamp the cap against the box. As an alternative, self-threading screws, such as sheet metal type screws can be used to fasten directly into the side 73.

Figure 9:
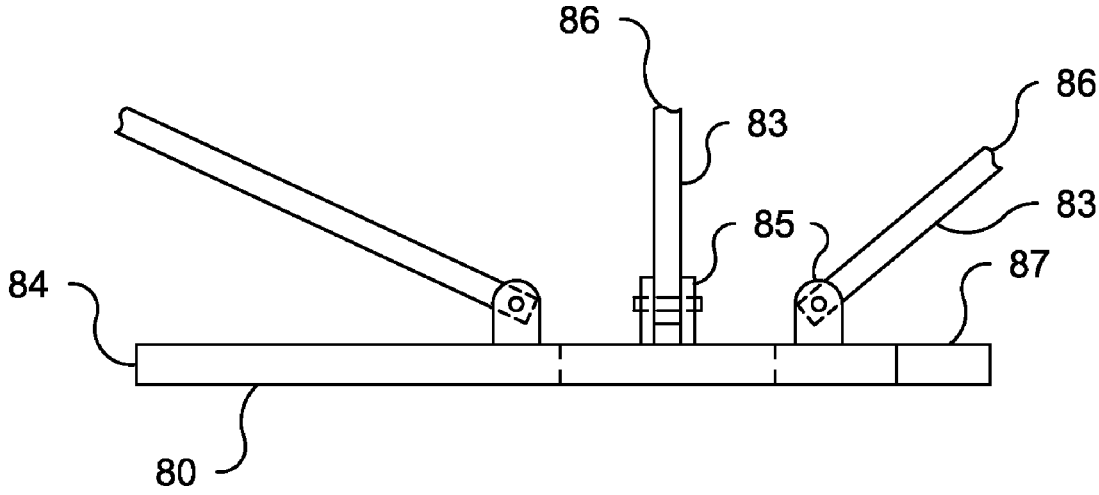
FIG. 9 is a side elevation view of a cap according to another embodiment of the novel cover.
Figure 10:
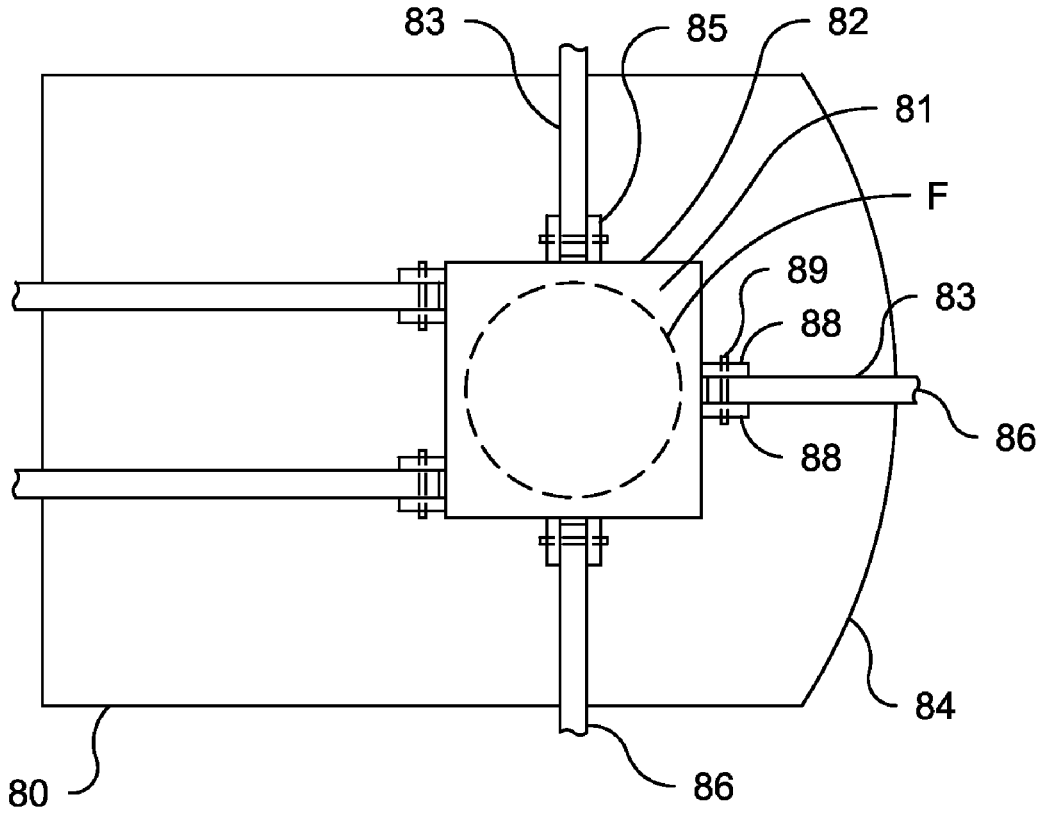
FIG. 10 is a plan view of the cap of FIG. 9.

In another embodiment shown in FIGS. 9 and 10, a cap 80 for the novel cover has a hole 81 defined by a straight-edged lip 82 and includes a plurality of elongated rigid struts 83. The struts are oriented radially from the lip 82 to the rim 84 of the cap. The top of the shell (not shown) can be supported and fixed to the struts. The struts are connected to the cap by pivotable joints 85 such that the strut ends 86 can be vertically adjusted with respect to the top surface of 87 of the cap. By attaching the shell to the strut ends, the top of the cover can be given a topographical contour. If the struts are raised such that the strut ends are equally distant above the surface 87, the top of the shell will be substantially flat. However, the strut end vertical adjustments can be set individually to provide the shell top with an irregular topographical contour. This permits the top to simulate natural plants that have such irregular peaks.

Conventional mechanisms known in the art can be used for the pivotable joints 85. For example, the joints can include a pair of spaced apart tabs 88 and an axle 89 passing through the tabs and the strut providing a pivot axis for the strut. The elevation of the strut end 86 can be fixed by a locking component of the joint. For example, a well known technique for applications such as this includes providing a first set of narrow, acute angled furrows on an inside face of a joint 85 in which each furrow radiates outwardly along the joint face from the pivot axis. There also is a second set of furrows on the strut end within the joint and facing opposite the first furrows. The first and second furrows are sized to mate. When the strut is raised to a desired elevation above the cap top, the tabs 88 are compressed against the strut end within the tab causing the opposing furrows to engage. The angle can be adjusted by releasing compression between tab and strut end, thereby freeing the furrows to rotate relative to each other, moving the strut to a different elevation and then re-compressing the tab against the strut to lock the furrows. Such connectors are found in many known utilities, such as elevating antennas and rods on marine vessels, to name one by way of example.

The openwork material of the shell can be attached to the ends of the struts 83 and/or at any one or more positions intermediate the ends of the struts. The material can be attached with wire ties, staples, or other like fasteners. The placement of struts illustrated in FIGS. 9 and 10, is representative. The struts can be located at any radial position about a datum point on the cap.

Figure 11:
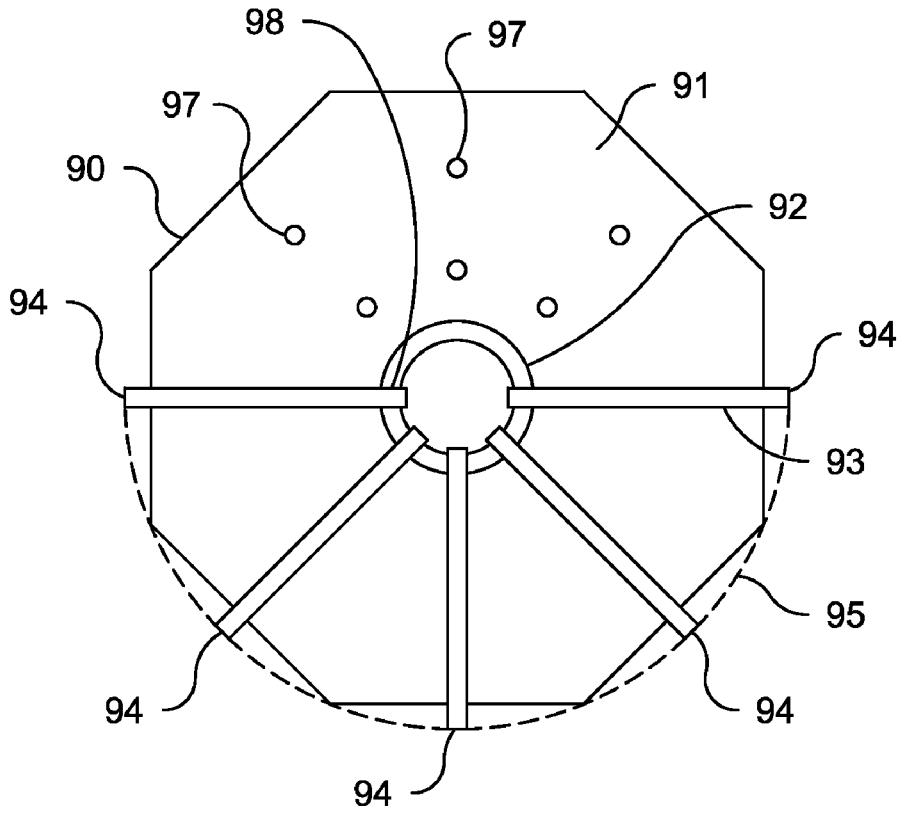
FIG. 11 is a plan view of a cap according to another embodiment of this invention.
Figure 12:
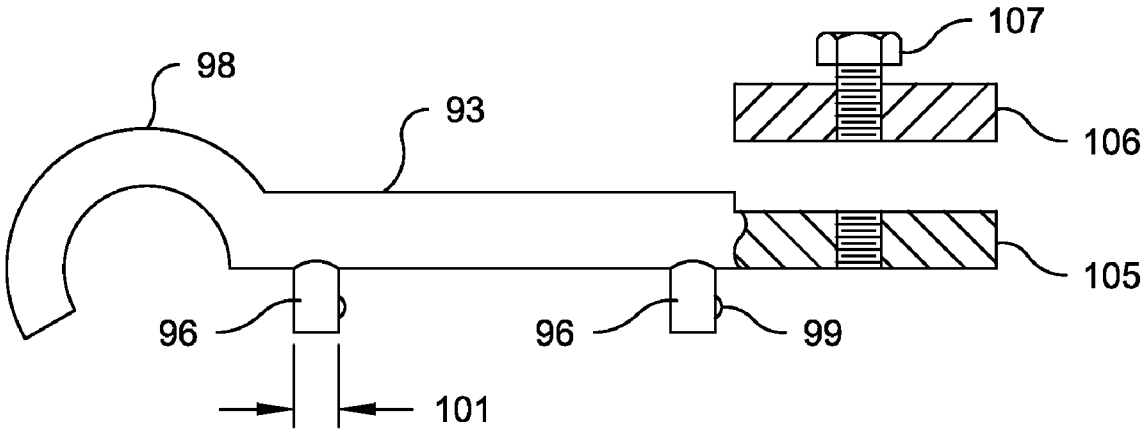
FIG. 12 is a side elevation view of an end of a strut for use in the cap of FIG. 11.

In another exemplary embodiment of the how the openwork shell material can be supported on the cap is understood with reference to FIGS. 11 and 12. Here the cap 90 includes a flat sheet 91 and a central support ring 92 affixed to the top surface of the cap. The ring need not be circular nor located in the geographic center of the cap. The struts 93 are intended to lie horizontally on the cap sheet 91 and to radiate outwardly from the central support ring 92 such that the strut ends 94 define a selected circumferential boundary 95 (shown in phantom lines) for the shell material to conform as it turns from vertical orientation along the sides of the cover to horizontal on the top. The struts are positioned at predetermined locations on the cap surface by inserting pegs 96 through locator holes 97. The locator holes are pre-drilled through the cap according to plan that will allow selected length struts to define correspond circumferential boundaries.

The struts can be locked to the cap by any of the well known means in the art. For example, the pegs can have spring-activated spheres 99 within sockets having slightly smaller diameter windows. The springs bias the spheres outwardly against the windows such that the overall distance 101 from the tip of the sphere and the opposite side of the peg is larger than the diameter of locator holes 97. As the peg is inserted through a locator hole 97, the sphere detents into the socket allowing the peg to fully insert. When the peg is fully inserted, the sphere is released by the wall of the locator hole and resets to distance 101 thereby preventing the peg from backing out of the locator hole. The struts can have hooked inner ends 98 adapted to mate with the support ring 92 and further secure the struts in place. Outer ends 105 of the strut can clamp to the top rail of the cover skeleton using any well known fastening technique. FIG. 12 illustrates in partial section view that the strut end 105 can be attached to the rail member 106 using a screw 107 for example.

Figure 13:
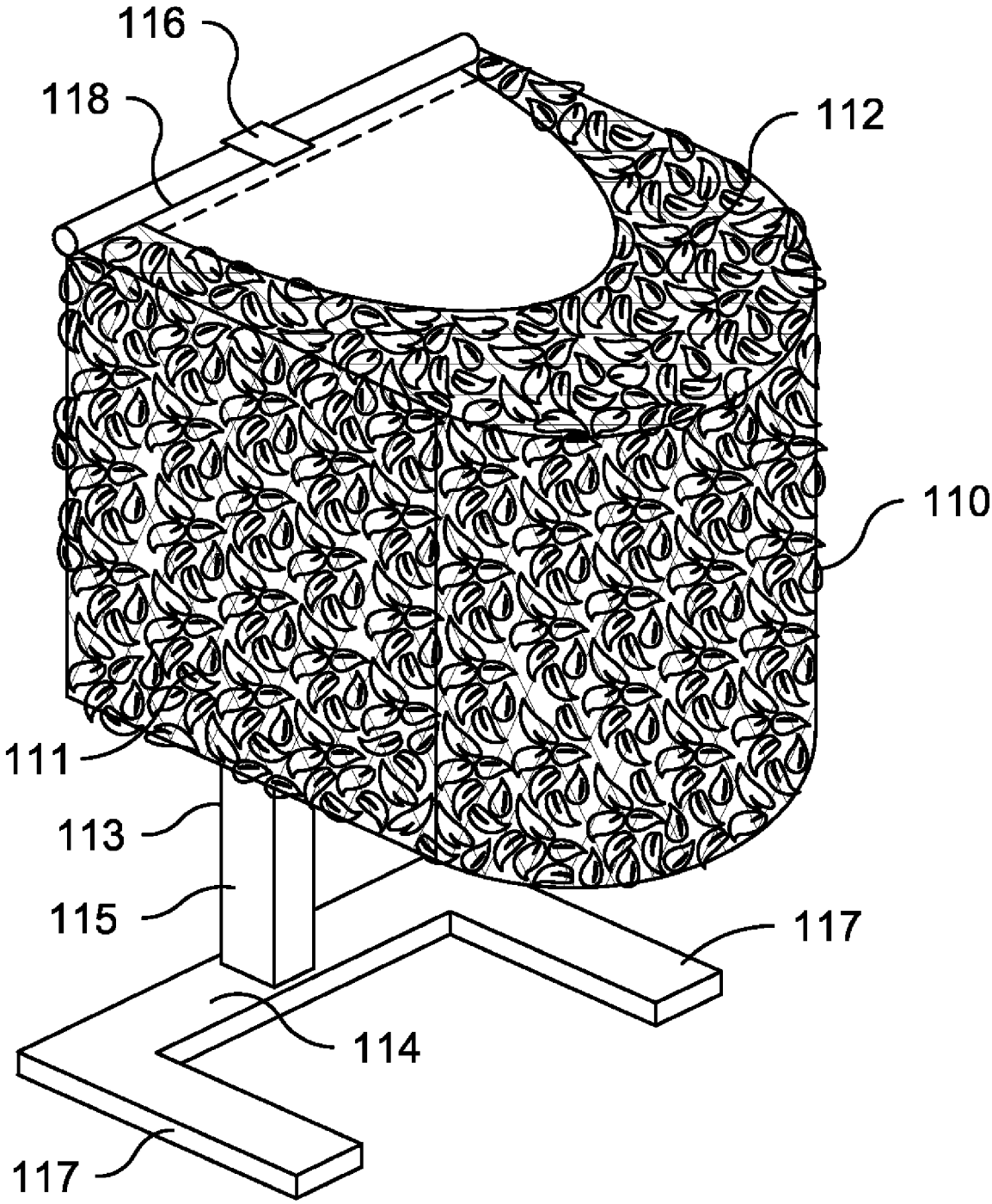
FIG. 13 is a perspective view of another embodiment of the utility cover according to this invention.
Figure 14:
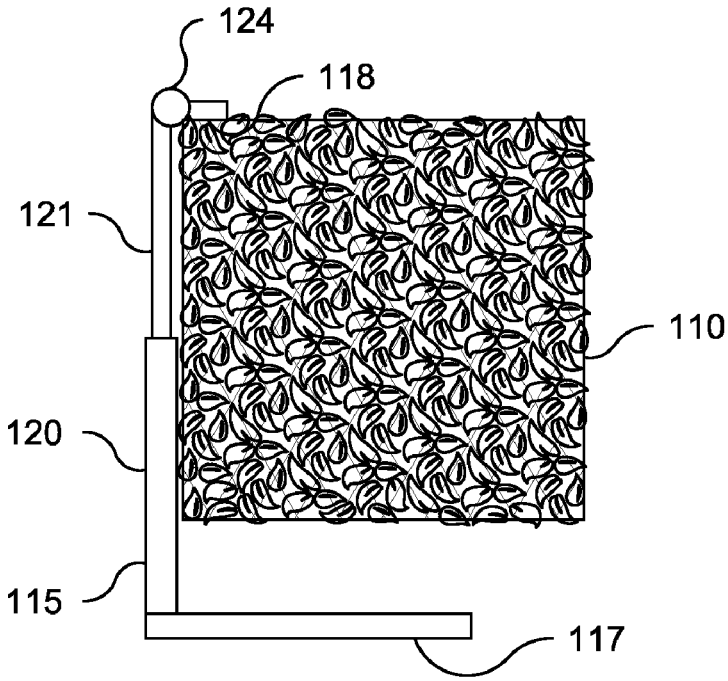
FIG. 14 is a side elevation view of the embodiment of the utility cover of FIG. 13 with the shell in position to conceal an object.
Figure 15:
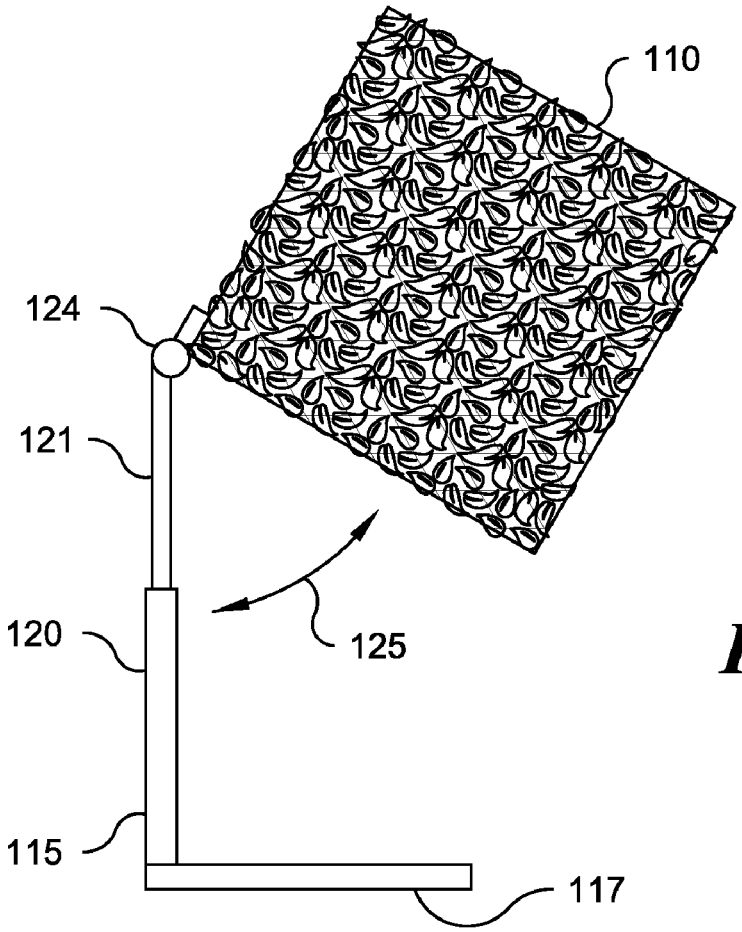
FIG. 15 is a side elevation view of the embodiment of the utility cover of FIG. 13 with the shell in a raised position to expose a concealed object for inspection or maintenance.

FIGS. 13-15 refer to still another embodiment. In addition to the skeleton, the shell of openwork, material 111 and foliage 112, the novel cover 110 includes a stand 113 adapted to hold the cover in position about the concealed object. The stand includes a base 114 sitting on the ground beneath the cover and at least one vertically oriented post 115 extending upward from the base. Usually the post is located at the rear of the cover, that is, behind the covered object and out of view from normal sightlines. The cap of the cover is affixed to the head 116 of the post. In this way the cap, the skeleton of rails and studs attached to the cap, and the foliage-adorned openwork shell material draped from the cap down the sides of the cover are all suspended by the stand 113. The base can take the form of any suitable, unobtrusive configuration. For example, it can comprise two forks 117 that extend forwardly under or alongside the object.

The post can have telescoping construction similar to that described for the studs. For example, the post 115, can have plural tubular sections 120,121 adapted to telescope within each other with the degree of telescoping adjusted by screwing one section into the other or similar well known methods. Hence the post can be height adjustable to raise and lower the cover as may be needed by the terrain, the object or the aesthetics of the local environment to most pleasingly conceal the object.

In a preferred embodiment, the head of the post 115 and the rim 118 of the cap are joined by one or more brackets. Preferably the rim is affixed to the bracket at the rear of cover. More preferably the bracket is a hinge 124 adapted to pivot about a horizontal axis such that the cover can swing upward or downward in the direction of arrow 125. With this feature, the cover including the whole openwork shell, the cap and the skeleton of rails and studs can be lifted high as seen in FIG. 15 to expose an object for inspection and maintenance as might be necessary from time to time. An optional prop can be provided to hold the cover in the elevated position while work is performed on the object. When the work is complete, the prop is removed or folded inside the cover for storage, and the cover is lowered back into position around the object.

Figure 16:
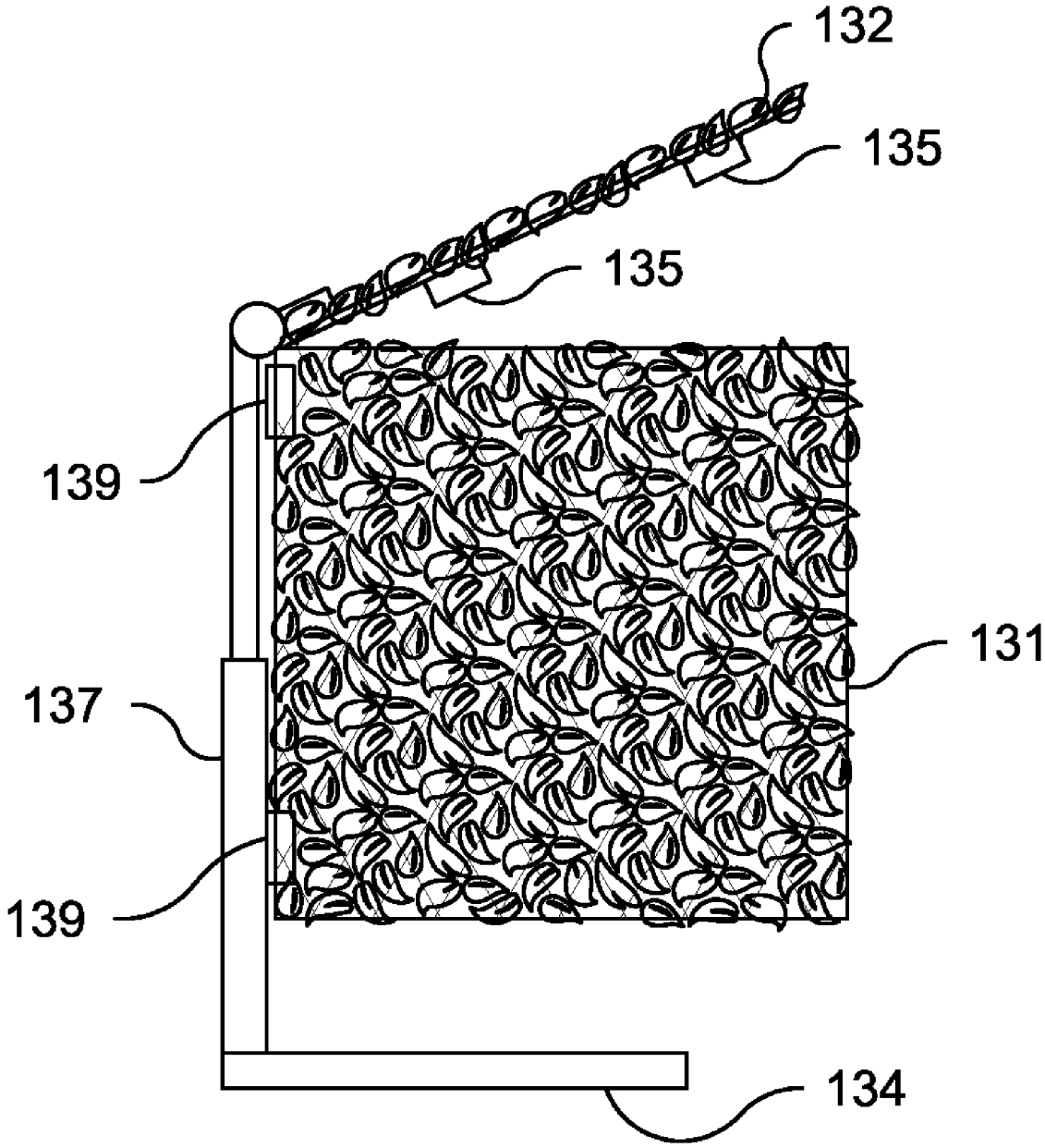
FIG. 16 is a side elevation view of another embodiment of the utility cover according to this invention.

In a further embodiment shown in FIG. 16, the openwork shell of the cover is severable and divided into at least two portions. One, lower portion 131 is the skirt area covering the predominantly vertical sides of the cover. The other, upper portion 132 is the cap-covering area of the shell which lies on the generally horizontal cap. In this embodiment, the cap is either permanently detached from the top rail or is easily detachable therefrom. If permanently detached, the upper portion rests on the lower portion under its own weight. If detachable, the underside of the upper portion can have quick disconnect fasteners, such as leaf spring compression clamps 135 to grab the elongated top rail. The lower portion 131 remains fixed when the upper portion is raised. If elevated above the base 134, the lower portion can be fastened to post 137 by brackets 139 for example. In another embodiment, the lower portion 131 can sit on the ground. With these modifications it can be seen that the upper portion, that is the cap with overlying portion of the openwork shell can be flipped rearward and upward to expose the object from above while leaving the skirt area portion of the cover in place.

Figure 21:
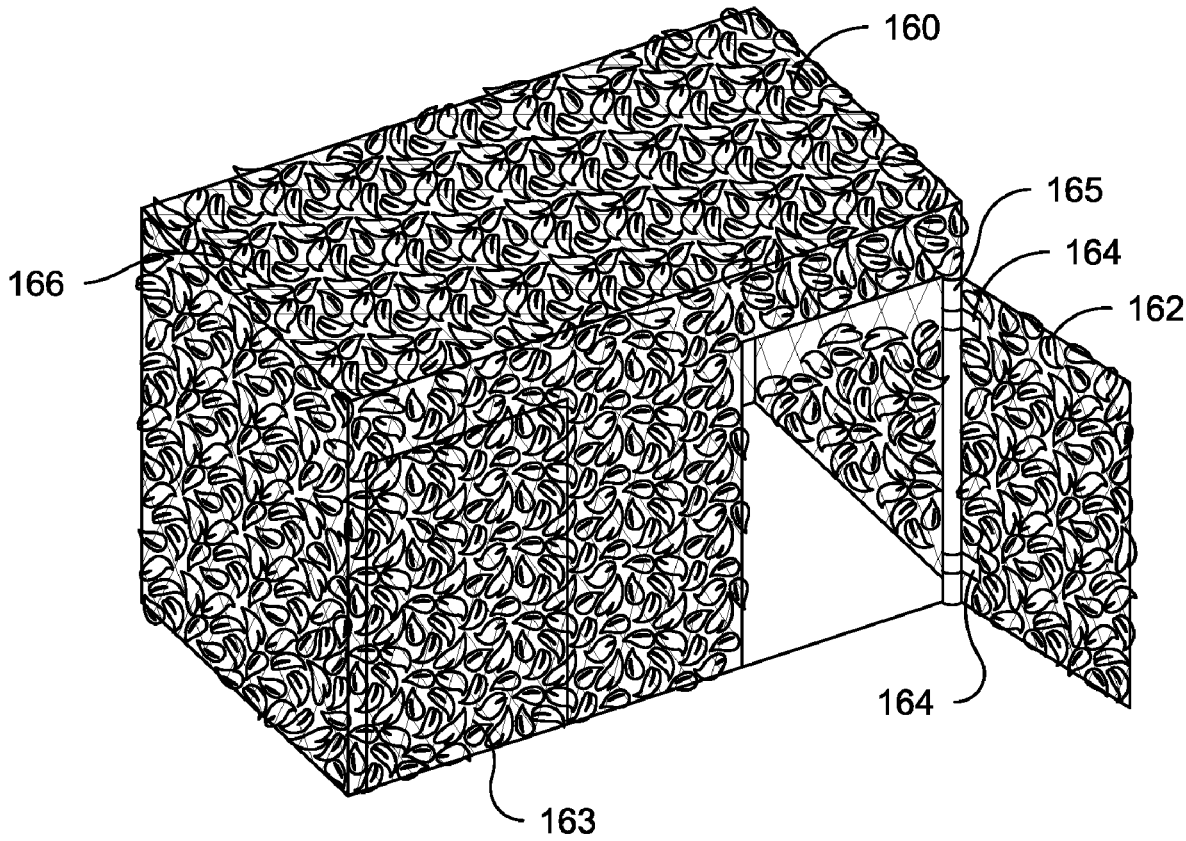
FIG. 21 is a perspective view of another embodiment of the utility equipment cover according to this invention.

In another embodiment as understood with reference to FIG. 21, the cover 160 includes laterally opening doors 162, 163, that pivot via hinges 164 about the axes of adjacent vertical studs 165. Such doors provide access to the interior of the cover which is especially useful for frequently removing and replacing objects such as trash receptacles stored under the cover. Optionally, the cap covering component 166 or portion thereof, also can be hinged to lift upward as illustrated in FIG. 16.

Figure 18:
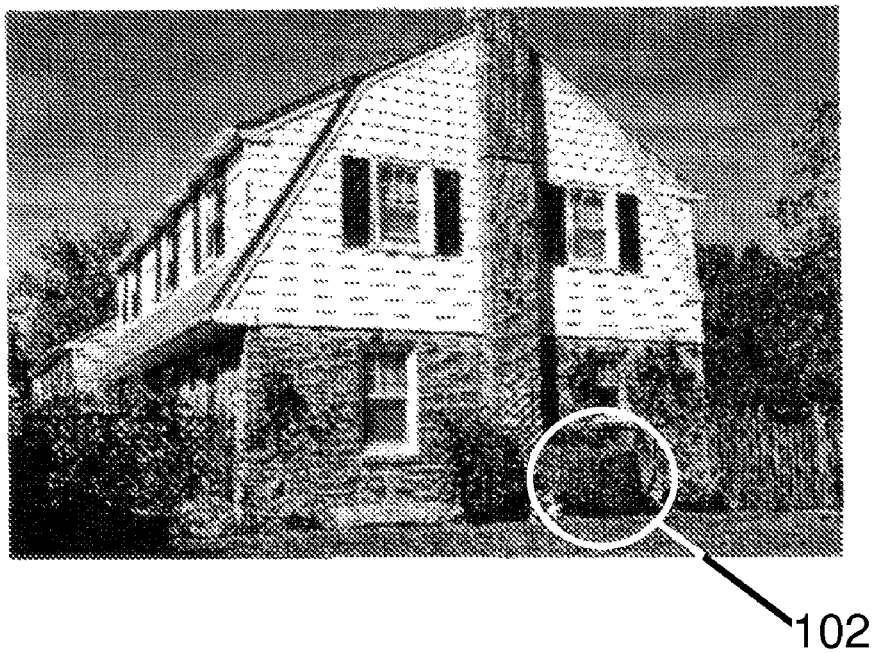
FIG. 18 is a photograph of an embodiment of an utility equipment cover in accord with this invention positioned around an air conditioner condenser unit adjacent a residential building.
Figure 19:
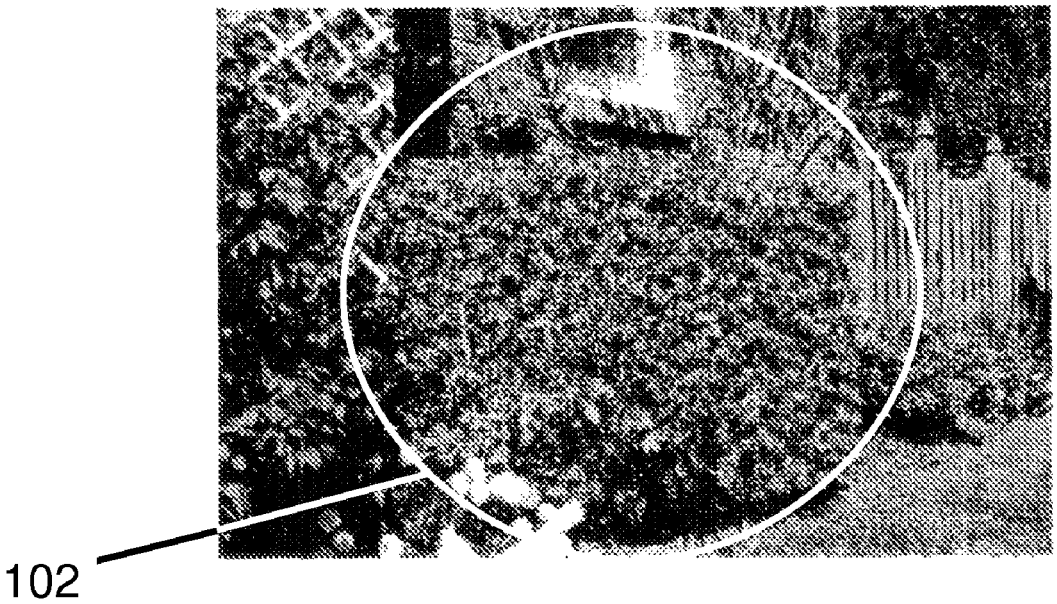
FIG. 19 is a detail photograph of the utility equipment cover of FIG. 18.

Typical objects that can be shielded by the novel container include air conditioner condenser units, telephone and electric utility access cabinets, satellite dishes, outdoor utility meter stations, furnace air intake and exhaust pipes, swimming pool filtration equipment, trash containers and the like. The ability accept ornamentation of natural-looking shrubbery and to conceal such utilitarian objects such that the concealed object blends aesthetically with the surrounding environment can be appreciated by inspection of a novel utility equipment cover 102 deployed in FIGS. 18 and 19.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A cover for shielding an object from view comprising a substantially horizontal cap adapted for placement above the object, the cap defining a peripheral outer rim and an inner hole with a peripheral inner lip, an elongated, substantially horizontally oriented top rail coextending with the rim, an elongated, substantially horizontally oriented bottom rail below and separated at every longitudinal position along the rail lengths from the top rail by a vertical distance exceeding the height of the object nearest such respective longitudinal position, a plurality of elongated, substantially vertically oriented studs spaced apart along the rail lengths and rigidly connecting the top rail with the bottom rail, an openwork flexible shell affixed to the studs and the rails and congruent with an area extending from the rail length of the bottom rail, over the top rail to the inner lip of the cap such that the shell blocks view of the object from at least three orthogonal horizontal directions and from above except for view of the inner hole, and artificial foliage applied to the shell in which the openwork of the shell defines voids, and in which the voids and the foliage are present to an extent effective to permit flow of air through the cover at least equal to ventilation specifications of the object.

2. The cover of claim 1 in which each of the rails comprises a plurality of elongated stiff members fastened together longitudinally head-to-tail with articulating connectors such that orientations of the stiff members along the rail lengths can be adjusted, thereby enabling a single cover to shield objects of different shapes from view, in which the articulating connectors comprise setting means for reversibly fixing the orientation of the rigid members.

3. The cover of claim 2 in which each stiff member of the rails comprises a plurality of elongated tubular components such that the stiff member lengths can be adjustably extended by telescoping one of said tubular components within another of said tubular components, thereby enabling a single cover to shield objects of different footprint area sizes from view.

4. The cover of claim 1 in which the studs are adjustably extendable within a specified range of stud lengths such that the distance of separation of the top rail from the bottom rail at each stud can be set independently of said distance at other studs, thereby enabling a single cover to shield objects of different heights from view.

5. The cover of claim 4 in which each stud comprises a plurality of elongated tubular components such that the lengths of the studs can be adjustably extended by telescoping one of said tubular components within another of said tubular components.

6. The cover of claim 5 which further comprises a plurality of settably deformable, elongated rods anchored in substantially vertical orientation at opposite ends to the top rail and the bottom rail and spaced apart along the rail lengths, in which shell is affixed at a plurality of points along each rod length, thereby enabling the shell to conform to a surface contour.

7. The cover of claim 6 in which each of the rails comprises a plurality of elongated stiff members fastened together longitudinally head-to-tail with angularly adjustable connectors such that orientations of the stiff members along the rail lengths can be adjusted, thereby enabling a single cover to shield objects of different shapes from view, in which the articulating connectors comprise setting means for reversibly fixing the orientation of the stiff members, in which each stiff member of the rails comprises a plurality of elongated tubular components such that the stiff member lengths can be adjustably extended by telescoping one of said tubular components within another of said tubular components, thereby enabling a single cover to shield objects of different footprint area sizes from view and in which the stiff members are oriented, the stiff member lengths and stud lengths are adjusted, and the rods are settably deformed such that the cover has a simulated appearance of a natural plant.

8. The cover of claim 1 in which the shell extending from the bottom rail to the inner lip of the cap includes at most a single piece of openwork flexible material.

9. The cover of claim 1 in which the cap includes a tubular sleeve inside the cover extending circumferentially from the inner lip of the hole toward the object, the sleeve being adapted to rest on the object and to define an axial channel through the sleeve for a flow of air exhausted upward by a fan of the object.

10. The cover of claim 9 in which the object is an air conditioner condenser unit having a horizontal top with an upwardly directed exhaust fan port protected by a fan guard fixed to the condenser unit by perforations in the top near the port, and in which the sleeve comprises prongs to connect the sleeve to the top using said perforations.

11. The cover of claim 1 in which the object is an air conditioner condenser unit with a case having vertical outer walls and in which the cover further comprises means for clamping the cap to said outer walls.

12. The cover of claim 1 in which the cap comprises a plurality of elongated, rigid struts extending radially between the inner lip of the hole and the outer rim of the cap.

13. The cover of claim 12 in which the struts comprise downward protruding pegs, the cap comprises a solid plate defining sockets at selected positions such that the pegs can insert into the sockets thereby aligning the struts of fixed strut lengths in a radial array which holds the top rail in a preselected shape at the outer ends of the struts.

14. The cover of claim 12 in which the struts are pivotally connected to the inner lip such that vertical orientation of the struts can be adjusted.

15. The cover of claim 1 which comprises a plurality of length-adjustable feet spaced apart along the bottom rail and descending downward from the bottom rail.

16. The cover of claim 15 which further comprises a flat horizontal mounting plate for an air conditioner condenser unit having bracket means for affixing the feet to said plate.

17. The cover of claim 1 which further comprises a stand operative to support the cover above ground, the stand comprising a base adapted to contact the ground near the object, and at least one vertically oriented post extending upward from the base to a head at an upper end of the post, and in which the rim of the cap is affixed to the head, thereby providing hanging support of the cover over the object.

18. The cover of claim 17 in which the rim is affixed to at least one head by a pivotable mounting bracket such that the cover as a whole can be raised to expose the object by pivoting the cap on a horizontal axis of the pivotable mounting bracket.

19. The cover of claim 18 in which cover is severable to form (a) a lid comprising the cap and a portion of foliage-bearing shell material on the cap, and (b) a facia comprising the rails, studs and foliage-bearing shell material on the rails and studs, and in which the cover is adapted such that the lid pivots on a horizontal axis of the pivotable mounting bracket to expose the object from above while the facia of the cover remains stationary.

20. The cover of claim 1 in which the openwork shell comprises a coarse mesh material having apertures of size at least about 1 square inch, and the cover further comprises a filter layer of fine mesh material having apertures of size at most about 0.25 square inch, said filter layer being positioned inside the cover and congruent with the shell.

* * * * *